United States Patent [19]

Lindberg

[11] 4,377,474

[45] Mar. 22, 1983

[54] APPARATUS FOR SEPARATING PARTICULATE OR LUMP MATERIAL BY SIZE

[75] Inventor: Gunnar B. Lindberg, Stockholm, Sweden

[73] Assignee: Rader Companies, Inc., Portland, Oreg.

[21] Appl. No.: 303,481

[22] Filed: Sep. 18, 1981

Related U.S. Application Data

[63] Continuation of Ser. No. 142,147, Apr. 21, 1980, abandoned, which is a continuation-in-part of Ser. No. 68,546, Aug. 22, 1979, abandoned, which is a continuation of Ser. No. 954,843, Oct. 26, 1978, abandoned.

[30] Foreign Application Priority Data

| | | | |
|---|---|---|---|
| Nov. 9, 1977 | [SE] | Sweden | 7712674 |
| Jan. 31, 1978 | [SE] | Sweden | 7801161 |
| Sep. 13, 1978 | [SE] | Sweden | 7809646 |

[51] Int. Cl.[3] ..... B07B 1/15

[52] U.S. Cl. ..... 209/279; 209/672

[58] Field of Search ..... 209/667, 672, 3, 233, 209/234, 236, 279, 281, 283, 288, 293, 296, 300, 350; 144/208 B, 208 J, 2 N, 309 AC

[56] References Cited

U.S. PATENT DOCUMENTS

| | | | |
|---|---|---|---|
| 2,410,147 | 10/1946 | Bleeke | 209/627 |
| 2,618,383 | 11/1952 | Chapman et al. | 206/231 |
| 2,966,267 | 12/1960 | Dunbar | 209/271 |
| 3,656,697 | 4/1972 | Nelson | 241/236 X |
| 3,870,627 | 3/1975 | Herkes | 209/3 |

FOREIGN PATENT DOCUMENTS

| | | | |
|---|---|---|---|
| 2221577 | 10/1974 | France . | |
| 158984 | 5/1957 | Sweden | 144/208 B |
| 265461 | 2/1927 | United Kingdom . | |
| 303970 | 1/1929 | United Kingdom . | |
| 455307 | 10/1936 | United Kingdom . | |
| 857826 | 1/1961 | United Kingdom . | |
| 311669 | 8/1971 | U.S.S.R. | 209/234 |
| 447179 | 4/1975 | U.S.S.R. | 209/233 |

*Primary Examiner*—Ralph J. Hill

*Attorney, Agent, or Firm*—Klarquist, Sparkman, Campbell, Leigh, Whinston & Dellett

[57] ABSTRACT

An apparatus for separating particulate or lump material by size having a passage for the material, downwardly defined by a plurality of rotationally drivable discs which are arranged in several rows. The discs in one row mesh with clearance between the discs in the nearest adjacent rows on either side, such that together the discs form a screen extending along the passage from an inlet for the material to be screened to an outlet for lumps of the material which are too large to fall through the screen. The principle axes of the disc rows are oriented in the flow direction of the material through the passage and locate the discs in a flat-sided trough-like configuration. The discs are adapted to be driven in such a direction that they impart to the material on the screen a transverse arching movement upwards and towards both sides of the passage, while the material simultaneously moves towards said outlet.

4 Claims, 4 Drawing Figures

APPARATUS FOR SEPARATING PARTICULATE OR LUMP MATERIAL BY SIZE

BRIEF DESCRIPTION OF THE INVENTION

This is a continuation of application Ser. No. 142,147, filed Apr. 21, 1980, now abandoned, which is a continuation-in-part of application Ser. No. 068,546, filed Aug. 22, 1979, which was a continuation of application Ser. No. 954,843, filed Oct. 26, 1978, both now abandoned.

The invention relates to an apparatus for separating particulate or lump material by size, and especially for screening wood chips. The apparatus has a passage for the material, downwardly defined by a plurality of rows of discs, the discs in one row meshing with clearance in spaces between the discs in the nearest adjacent rows on either side. The discs are arranged on each side of the center of the apparatus to form a flat-sided, trough-like screen extending along the passage from an inlet for the material to be screened to an outlet for lumps of the material, e.g. coarse wood chips, which are too large to fall through the screen.

The object of the invention is to provide an apparatus of the kind described above which permits accurate differentiation in size of the separated fraction and attains such with efficiency.

A further object of the invention is to provide screening apparatus for wood chips and the like which will not bind or clog.

Due to variations in temperature and moisture content, for example, the material screened in the apparatus may possess varying characteristics, not the least of which may be different angles of repose. Such variations also affect screening characteristics, and especially screening capacity. A still further object of the invention is therefore to provide an apparatus of the kind described in the opening paragraph, which is adaptable to varying material characteristics, in order to obtain the maximum screening capacity possible.

Other objects and advantages will become apparent hereinafter.

Figure 1:
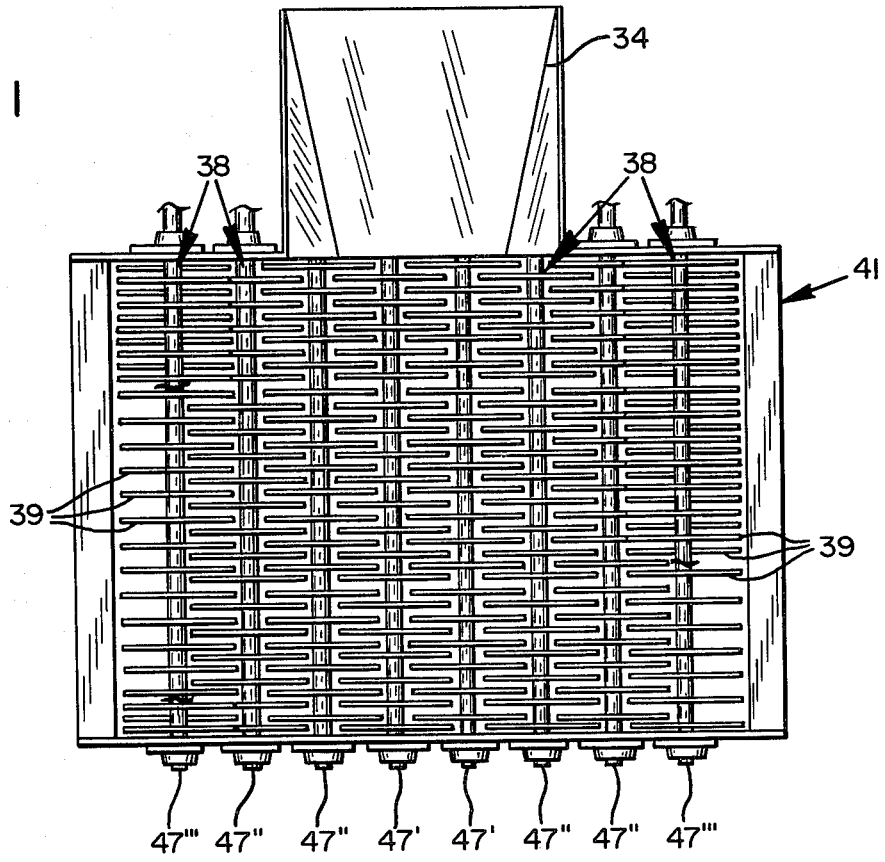
FIG. 1 is a fragmentary top view of apparatus constructed in accordance with the invention, with the disc-group on each side arranged at the same angle.

Referring to the drawings, the apparatus illustrated is a disc screen particularly suitable for screening cellulose chips. The angle of repose of the chips varies, inter alia, due to the time of year (whether the chips are frozen or not) and by the moisture content of the chips.

The screen has a frame 31 with a chip inlet opening 32 in an end wall 33. The chip inlet is formed by an upwardly open hopper 34, extending inwards from the outside of the end wall with its bottom and side walls through the opening 32. In the opposite end wall there is an outlet 35 for coarse chips. The bottom 36 of the apparatus is open for removing prime chips and screen dust sifted through the screen.

A passage 37 runs between the inlet 34 and outlet 35, this passage being downwardly and laterally defined by a large number of discs 39 mounted on parallel shafts 47 and arranged in a plurality of rows 38. The embodiment shown has ten such rows 38, which are parallel and oriented in the flow direction of the feed for the chips through the passage 37.

The discs 39 are fixed to the shafts 47 and driven via the shafts and chain wheels 40 on one end of the shafts. The discs 39 mesh with suitable clearance between the discs in the adjacent row or the rows on either side, so that taken together the discs serve the purpose of a self-clearing screen extending along the passage.

Figure 2:
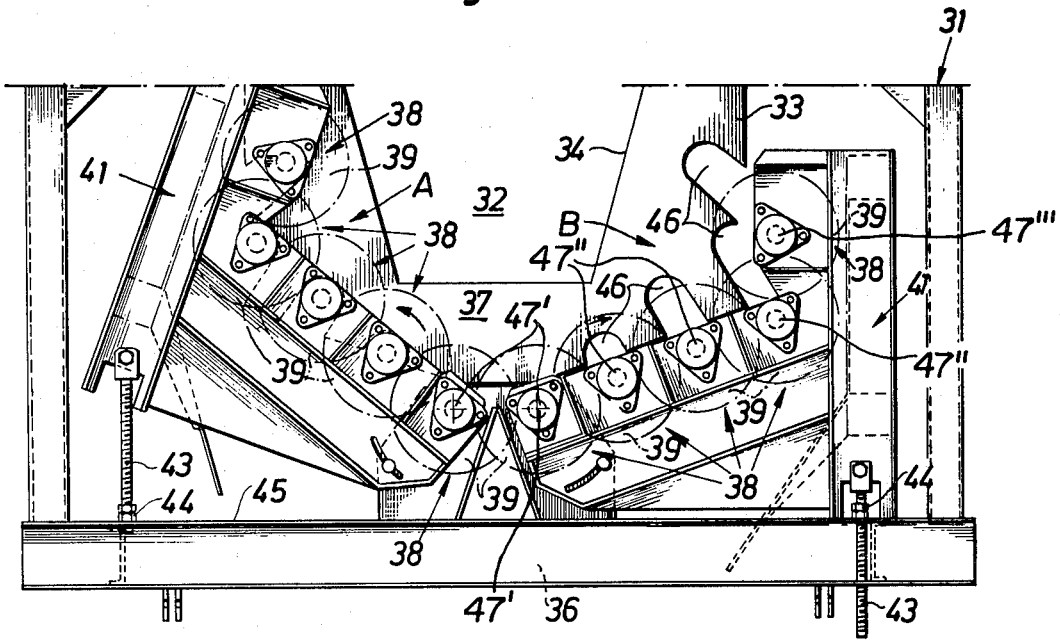
FIG. 2 is an end view of the apparatus.
Figure 3:
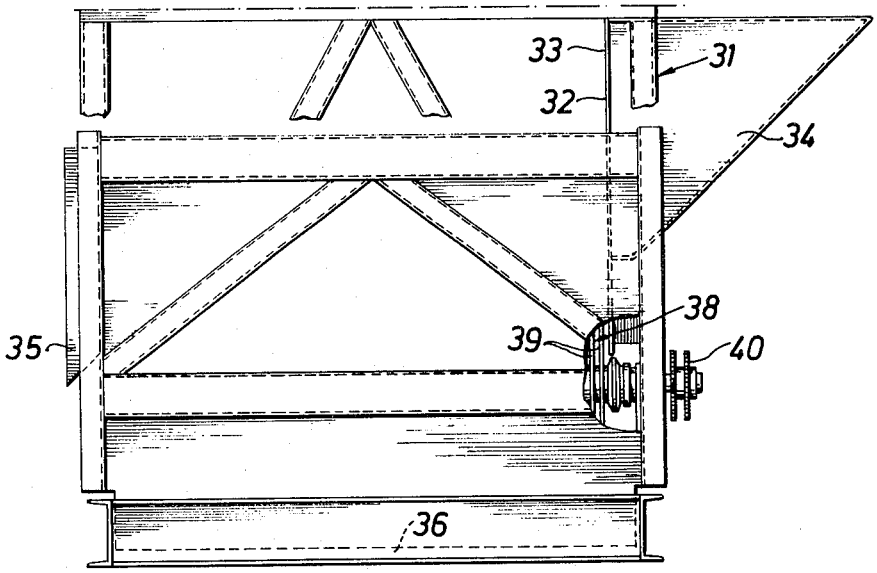
FIG. 3 is a partially cut-away side view of the apparatus.

Referring to FIG. 2, the disc rows are arranged in two groups A and B, one on each side of the longitudinal axis of the apparatus. Each group consists of a frame or support means 41 that is pivotally mounted on the shaft 47' of the centermost disc row 38 of the group, such shaft in turn being journaled in the frame 31. Thus, the frame 41 can be pivoted up and down about the shafts 47', adjusting screws 43 and nuts 44 on the bottom beam 45 being provided for that purpose. Recesses 46 are provided in the end wall 33 to accommodate the ends of the shafts 47 as they swing upwardly.

Each group A and B includes a set of four shafts 47' and 47'' mounted in the frame 41 with their axes lying in a plane inclined at an acute angle of between about thirty to forty degrees and preferably about thirty-four degrees. FIG. 2 shows group A tilted at a greater angle than group B. Each group also includes one further shaft 47''' located at the outer edge of each group and above the plane thereof. The discs in each group are driven in the directions indicated in FIG. 2 so that the top portions of the disc rotate away from the longitudinal axis of the apparatus.

With the illustrated arrangement the four innermost disc rows 38 of each group present a relatively flat top surface or bed to the wood chips being processed and the chips are distributed relatively evenly laterally over each group of discs whereby the efficiency of the screening operation is enhanced. This even distribution of chips is to be compared with the windrowing which occurs in the instance of devices wherein the shafts for the discs are mounted on an arc. The outermost disc rows 38 mounted on the shafts 47''' act as fences to contain material on the bed of discs and project any material reaching such discs back toward the longitudinal axis of the apparatus.

While the apparatus may be operated with the shaft axes horizontally disposed, preferably the apparatus is arranged so that the longitudinal axis is inclined at an angle of between about five to ten degrees from the inlet to the outlet. This angle assists in the progression of oversize materials to the outlet. Any suitable means may be provided to adjust the apparatus to attain this inclination.

Figure 4:
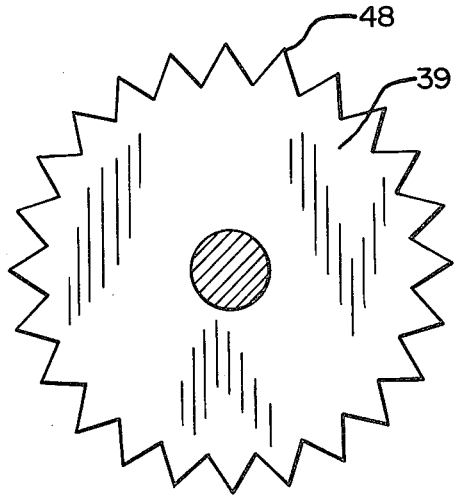
FIG. 4 is a side view of one form of a suitable disc.

Preferably the discs are formed with teeth 48 as shown in FIG. 4 or are fluted, wavy, or have some other kind of material-urging or material-orientating shape.

The discs can suitably be arranged with successively increasing spacing, or jumped increases thereof, along the passage from the inlet towards the outlet, so that different fractions can be taken off at different places under the screen. Even the size of the disc, usually its diameter can conceivably be varied, suitably in steps for groups of discs.

The apparatus can be provided with only one settable group of disc rows, especially if all the discs are driven in the same direction for lifting up the chips along only one side of the passage. Neither do the group or groups of settable rows need to be arranged in pivotable means. Rows displaceable in groups or individually in some other way, e.g. linearly by means of piston-cylinder devices can also be arranged.

I claim:

1. Apparatus for the separation by size of particulate material such as wood chips, comprising a plurality of parallel shafts arranged in two groups one on each of the opposite sides of a longitudinal central axis parallel to said shafts, the axes of said shaft of each group lying substantially in a plane inclined at an acute angle upwardly from said axis, each of said shafts having a plurality of discs fixedly mounted thereon, the discs on each shaft being interleaved with the discs on adjacent shafts, means connected to said shafts for driving each group so that the discs thereon rotate in the direction away from said axis in the upper part of their rotation, and means at one end of said apparatus for feeding particulate material to be sieved into said apparatus longitudinally of said central axis whereby the rotating discs cause the particulate material to be thrown upwardly and outwardly and distributed over said discs, the material of a size less than the spacing between the intermeshed discs falling between said discs, the material larger than said spacing being moved toward and discharged from the opposite end of said apparatus.

2. Appartus as set forth in claim 1 wherein said acute angle is between about 30° and 40°.

3. Apparatus as set forth in claim 2 wherein said apparatus axis is inclined downwardly from said one end.

4. Apparatus for the separation by size of particulate late material such as wood chips, comprising a plurality of parallel shafts arranged in a group on one side of a longitudinal axis parallel to said shafts, the axes of said shafts lying substantially in a plane inclined at an acute angle of between 30 degrees and 40 degrees upwardly from said axis, each of said shafts having a plurality of discs fixedly mounted thereon, the discs on each shaft being interleaved with the discs on adjacent shafts, means connected to said shafts for driving the discs thereon to rotate in the direction away from said axis in the upper part of their rotation, and means at one end of said apparatus for feed particulate material to be sieved into said apparatus longitudinally of said longitudinal axis, whereby the rotating discs cause the particulate material to be thrown upwardly and outwardly and distributed over said discs, the material of a size less than the spacing between the intermeshed discs falling between said discs, the material larger than said spacing being moved toward and discharged from the opposite end of said apparatus.

* * * * *